US005083916A

United States Patent [19]

Glennon et al.

[11] Patent Number: 5,083,916

[45] Date of Patent: Jan. 28, 1992

[54] FUEL COMBUSTION APPARATUS AND METHOD

[75] Inventors: Barry Glennon, Conyers, Ga.; Charles W. Sesma, Moreno Valley, Calif.

[73] Assignee: Glen Co. Enterprises, Inc., Conyers, Ga.

[21] Appl. No.: 472,776

[22] Filed: Jan. 31, 1990

[51] Int. Cl.[5] ..... F23D 14/28

[52] U.S. Cl. ..... 431/344; 126/407; 126/414

[58] Field of Search ..... 126/411–414, 126/407, 409, 401, 404; 431/328, 354, 344; 222/2

[56] References Cited

U.S. PATENT DOCUMENTS

| | | | |
|---|---|---|---|
| 3,399,951 | 9/1968 | Koizumi | 431/344 |
| 3,409,049 | 11/1968 | Racek | 431/344 |
| 3,860,385 | 1/1975 | Nakanishi | 431/344 |
| 4,119,088 | 10/1978 | Sim | 126/413 |
| 4,746,288 | 5/1988 | Graham | 431/344 |
| 4,858,593 | 8/1989 | Hsu | 126/413 |
| 4,892,086 | 1/1990 | Ichikawa | 431/344 |

*Primary Examiner*—James C. Yeung
*Attorney, Agent, or Firm*—Hopkins & Thomas

[57] ABSTRACT

A fuel combustion apparatus having means for eliminating liquid fuel emissions at the combustion zone. The apparatus can be used as a open-flame torch, or alternatively it can be used as a soldering tool. The nozzle for an open-flame application, and the soldering tip assembly are readily interchangeable. The device is lightweight, portable, and refillable. Dual, finned radiators and an insulator prevent heat from being transferred from the combustion zone to the body of the fuel combustion apparatus.

10 Claims, 1 Drawing Sheet

FUEL COMBUSTION APPARATUS AND METHOD

BACKGROUND OF THE INVENTION

1. Field of the Invention

This invention relates to an apparatus and method for fuel combustion. More particularly, the invention comprises an apparatus which can be used either as an open-flame torch, or which can be used as a soldering tool, capable of generating high temperatures. The apparatus includes valve assemblies that substantially eliminate liquid fuel emission from the device, and that also provide other safety features. The device is lightweight, portable, and includes means to refill its fuel chamber. The device provides efficient and safe fuel combustion at any orientation.

2. Description of the Prior Art

Portable, fuel combustion devices, such as gas lighters, are widely known. These devices typically include a fuel cartridge or canister for containing pressurized fuel, and appropriate valve assemblies for releasing the fuel in a controlled manner. Such gas lighters are disclosed in U.S. Pat. No. 4,181,493 to Piffath, et al., U.S. Pat. No. 3,820,941 to Blank, and U.S. Pat. No. 3,523,006 to Piffath, et al. These devices include relatively simple and inefficient gas regulating and valve assemblies, and are not generally suitable for commercial applications. They are generally suitable only as providing a simple ignition source.

Other devices, however, have been developed to provide for fuel combustion for use in more specific applications, such as pipe fitting. These devices generally include a relatively large butane gas tank with a removable valve assembly having an elongated nozzle. Recently, various other devices have been developed, which accomplish controlled fuel combustion for use in a soldering tool. For example, U.S. Pat. No. 4,785,793, and European Patent No. 118,282, both to Oglesby. et al., disclose a portable soldering tool having a fuel cartridge and valve means for regulating the emission and combustion of the fuel. A soldering tip is carried by the device, and the sole application of the device is as a soldering tool. The Oglesby patents are directed specifically to a heat conductive support member included within the soldering tip for solely supporting the soldering tip.

These prior art devices generally have been found to be both inefficient in the delivery and combustion of fuel, and, at times, unsafe. A common problem with such devices is uneven burning or "flame up" caused by liquid fuel, such as liquid butane, entering the combustion zone. This is an extremely unsafe condition, and usually occurs when the device is pointed downwardly or jarred. Also, the control valve mechanisms on these prior art devices allow fuel to be delivered to the combustion zone in a "burst" when the valve is first opened. U.S. No. 4,133,301 to Fugiwara, discloses another gas combustion apparatus comprising a soldering tool. This device includes an arrangement of gas inlet lines and an ignition circuit, and is comparatively more complex and cumbersome than many other, portable devices.

SUMMARY OF THE INVENTION

Briefly described, the present invention includes a cylindrical housing which defines a refillable fuel chamber. The housing also includes therein valve assemblies for regulating the flow of fuel from the fuel chamber. The valve assemblies include an anti-sputter valve, which assists in preventing the emission of liquid fuel, such as liquid butane, from the device. Operating in conjunction with the anti-sputter valve is a control valve assembly which efficiently regulates the emission, or outflow, of fuel, while providing for two separate fuel passage closure means in series. An external control knob actuates the internal control valve assembly to selectively regulate the fuel emission.

A first, finned heat exchanger or radiator is positioned downstream of the control knob to ensure that heat is not transmitted either to the control knob or to the fuel chamber. A tubular element comprising a fuel mixing member abuts the first radiator and supports a second, finned radiator. This second finned radiator terminates either in a nozzle assembly for open flame combustion, or alternatively supports a catalytic soldering tip.

The device is designed to be relatively compact and lightweight, so as to be readily portable. The particular valve assemblies in the device also provide for a much safer combustion apparatus and method than is accomplished by the known prior art. For example, the device substantially eliminates the emission of liquid butane from the nozzle, as is common in the prior art The emission of and subsequent combustion of liquid butane by devices of the prior art, constitutes a safety hazard because the flame at the nozzle can become greatly extended when the devices of the prior art are oriented downwardly or jarred. Another important safety feature of the present device, which is not found in the known prior art, is the valve closure assemblies disposed in series. These assemblies ensure that when the device of the present invention is turned off, fuel is bled out of the valve assembly, so that when the device is later used there is not a "burst" of fuel from the nozzle when the control knob is actuated. The present invention, therefore, includes many differences from and advantages over the known prior art combustion devices.

Accordingly, it is an object of the present invention to provide a fuel combustion apparatus which is efficient in operation and durable in structure.

Another object of the present invention is to provide a fuel combustion apparatus which can be utilized either as an open flame gas torch or as a soldering tool.

Another object of the present invention is to provide a fuel combustion apparatus which is lightweight, portable, and easily used in environments having space restrictions.

Another object of the present invention is to provide a fuel combustion apparatus which is safe in operation.

Another object of the present invention is to provide a fuel combustion apparatus which prevents the emission of liquid butane into the combustion zone.

Another object of the present invention is to provide a fuel combustion apparatus which includes an anti-sputter valve assembly.

Another object of the present invention is to provide a fuel combustion apparatus which includes fuel regulating or valve assembly means capable of closing the fuel passageway in two separate areas.

Another object of the present invention is to provide a fuel combustion apparatus in which the volume of fuel dispensed can be selectively controlled within a predefined quantity.

Another object of the present invention is to provide a fuel combustion apparatus in which the length of an open flame can be readily and accurately controlled.

Another object of the present invention is to provide a fuel combustion apparatus which includes means to prevent heat from contacting the control knob or fuel tank.

Another object of the present invention is to provide a fuel combustion apparatus in which the air-fuel mixture zone is positioned upstream of the nozzle assembly.

Another object of the present invention is to provide a fuel combustion apparatus which is easily refilled with fuel.

Another object of the present invention is to provide a fuel combustion apparatus which includes a soldering tip having a catalytic heating element for generating high temperatures.

Another object of the present invention is to provide a fuel combustion apparatus in which a finned radiator is insulated from the body of the apparatus.

Another object of the present invention is to provide a fuel combustion apparatus in which no combustible air-fuel mixture exists upstream of the control valve assembly.

Another object of the present invention is to provide a fuel combustion apparatus which includes locking means to restrict the actuation of the control knob, thereby controlling the amount of maximum fuel flow and preventing the control knob from being easily removed.

Another object of the present invention is to provide a fuel combustion apparatus including a valve assembly providing positive seating to prevent gas flow and to render the apparatus substantially leak proof.

Another object of the present invention is to provide a fuel combustion apparatus which is difficult to disassemble by the user.

Another object of the Present invention is to provide a fuel combustion apparatus which includes means positioned in the fuel passageways to absorb liquid fuel.

Another object of the present invention is to provide a method for fuel combustion in which the passage of fuel from the fuel tank to the combustion zone is accurately and safely regulated.

Another object of the present invention is to provide a method for fuel combustion in which substantially no liquid fuel enters the combustion zone.

Another object of the present invention is to provide a method for fuel combustion in which the passage of fuel through the fuel passageway can be shut off in two separate areas, in series.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENTS

Figure 1:
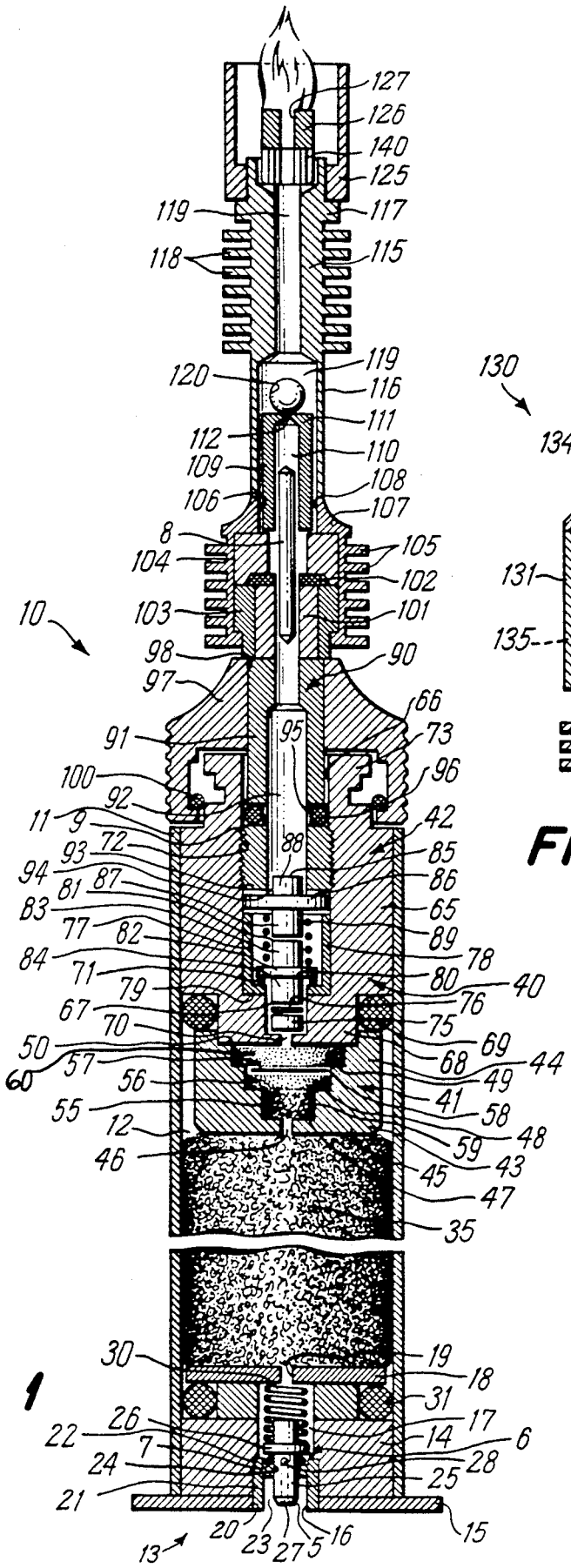
FIG. 1 is a cross-sectional view of the fuel combustion apparatus, taken generally along the longitudinal axis of the apparatus.

Referring now in detail to the embodiments chosen for illustrating the present invention, FIG. 1 depicts a fuel combustion assembly 10 having an elongate, tubular, housing 11 defining therein a chamber 12. Partially received within chamber 12 at one end of housing 11 is fuel inlet assembly 13. Various fuel inlet assemblies well known in the art will perform satisfactorily with the present invention. Inlet assembly 13 includes tubular body 14, having annular flange 15 which defines therein filling orifice 16. Cylindrical body or plug 14 defines axially extending passageway 17 therethrough. Plug 14 also includes upper plate 18 which defines central aperture 19. Received within passageway 17 is inverted cup-shaped valve seat 20. Valve seat 20 includes cylindrical side walls 21 and upper wall 22, and defines hollow interior or chamber 23. Side wall 21 and bottom wall 22 also define annular recess 6 into which is received annular, rubber gasket 7. Bottom wall 22 also defines therethrough, central aperture 24. Elongate, cylindrical plunger 25 having annular flange 26 integral thereto and defining axial passageway 27 partially therethrough, is received in orifice 24, as shown in FIG. 1. Plunger 25 defines orifice 28 below flange 26 so that when flange 26 abuts gasket 7 as shown in FIG. 1, orifice 28 is adjacent to wall 22 below flange 26, thereby being effectively closed off. Coil spring 30 is disposed in compression between wall 18 and flange 26 of plunger 25, so that spring 30 normally urges plunger 25 downward, causing flange 26 to abut or seat against gasket 7.

Since axial passageway extends from the lower end 5 of plunger 25 to orifice 28, it is therefore obvious that manually biasing plunger 25 upwardly against the force of spring 30, will allow orifice 28, and thereby axial passageway 27, to communicate with chamber 17, thus allowing fuel to flow through axial passage 27 and orifice 28 into chamber 17 and out of orifice 19. Spring 30 then biases plunger 25 to a normally closed position when external force is removed from plunger 25 against spring 30. Annular, rubber sealing gasket 31 is received around plug 14 below wall 18 in order to prevent fuel from passing between cylindrical housing 11 and tubular body 14. Flange 15 also provides a supporting base for apparatus 10.

Contained within chamber 12 above plate 18 is porous sponge 35. Sponge 35 is preferably comprised of a porous elastomeric polymer material, such as expanded polyurethane foam. The volume of chamber 12 occupied by porous sponge 35 constitutes the fuel holding portion of chamber 12.

Immovably disposed within chamber 12, opposing and spaced from inlet assembly 13, is fuel regulating assembly 40. Fuel regulating assembly 40 is comprised of anti-sputter valve assembly 41 and control valve assembly 42, which are integrally joined. Anti-sputter valve assembly 41 is positioned spaced from wall 18 and immediately above sponge 35 and is comprised of upwardly opened, cup-shaped body 43 having cylindrical side walls 44 and bottom wall 45 which defines central orifice 46. The interior of cup-shaped body 43 includes a series of annular shoulders 47, 48, 49, and 50 defined by the interior of annular side walls 44, as shown in cross-section in FIG. 1. Cup-shaped body 43 therefore defines an open interior of progressively increased volume. Received within the interior of cup-shaped body 43 and abutting shoulder 47 is a cylindrical sponge or impregnated rubber cork 55. Cork 55 does not extend above shoulder 48. Positioned above cork 55 and supported by shoulder 48 is annular, microporous disk 56. Disk 56 is preferably made of high density, microcellular, open-celled polyurethane or similar synthetic material. Annular, solid brass disk 57 is positioned above disk 56, below shoulder 49. The diameter of annular, solid brass disk 57 is such that a preferred clearance of approximately one thousandth of an inch is maintained between the circumferential edge 58 of disk 57 and the upstanding, annular side wall 59 of the interior of body 44 above annular shoulder 48. Positioned above brass disk 57 and abutting shoulder 49 is a second microporous disk 60, again comprised of high density, microcellular, open-celled polyurethane or similar synthetic material. As is more fully hereinafter discussed, the elements of anti-sputter valve 41 have several functions, including the prevention of an uncontrolled rush or "blast" of fuel into control valve assembly 42, and assisting in the prevention of liquid fuel from entering the combustion zone.

Elongate control valve assembly 42 is positioned above anti-sputter valve assembly 41, and includes annular side wall 65 having annular, inner wall 66 defining longitudinally extending, axial passageway 67. The lower end of side wall 65 is of decreased diameter, defining annular flange 68. As shown in FIG. 1, a portion of flange 68 is received into the interior of body portion 43 within wall 44, and abuts annular shoulder 50. In the manufacturing process, control valve assembly 42 and anti-sputter valve assembly 41 are press-fit together with an arbor press, and so are integrally attached. At their respective points of attachment and between assemblies 41 and 42 is annular, rubber gasket 69 which ensures that fuel flow cannot occur between cylindrical side wall 65 of control valve assembly 42 and housing 11, but rather is directed through orifice 46 of anti-sputter valve assembly 41.

Flange 68 defines therethrough, central orifice 70. The interior side wall 66 defines annular shoulder 71 and threads 72. The upper portion of body 65 terminates in annular retaining flange 73. Positioned within passageway 67 and abutting shoulder 70 is microporous, cylindrical, sponge-rubber cork or plug 75. Above cork 75 is positioned solid brass disk 76. Contained within passageway 67 and supported by and abutting shoulder 71 is upstanding, cylindrical, cup-shaped valve seat 77 having cylindrical side walls 78 and bottom wall 79 defining orifice 80 therethrough. Valve seat 77 is preferably made of a synthetic material such as Teflon®. Solid, brass plunger 81 having centrally disposed, annular flange 82, upper boss 83 and lower boss 84, is received within the interior of valve seat 77 with lower boss 84 protruding through orifice 80. A second plunger 85, similar in design to, but slightly larger than plunger 81, is positioned within passageway 67. Centrally disposed, annular flange 86 of plunger 85 abuts the circumferential top edge of valve seat 77, with lower boss 87 of plunger 85 protruding into the interior of seat 77, and upper boss 88 of plunger 85 projecting above flange 86. Coil spring 89 is placed in compression between flange 82 of lower plunger 81 and flange 86 of upper plunger 85, as shown in FIG. 1, so that bosses 83 and 87 are received within valve seat 77, and maintain spring 89 in alignment therebetween. Cup-shaped valve seat 77 also serves to maintain spring 89 in axial alignment.

When upper plunger 85 is in its lowermost position, abutting against the upper, circumferential edge of seat 77, spring 89 forces lower plunger 81 downwardly. In this position, there is always a gap between boss 83 of lower plunger 81 and boss 87 of upper plunger 85. Boss 83 and boss 87, therefore, never contact one another. As is hereinafter further discussed, preferably there is a gap of approximately one thousandth of an inch between the circumferential edge of flange 85 and interior side wall 66, to allow for the passage of fuel between side wall 66 and the circumferential edge of flange 85. Also received within passageway 67 is elongate, tubular, control valve stem 90, having cylindrical side wall 91, and defining therethrough axial passageway 92. Side wall 91 includes external threads 9 along its lower portion and also includes bottom wall 93 which defines orifice 94 therein. Boss 88 is received in passageway 92 through orifice 94. A diametric slot (not shown) is cut into bottom wall 93 across orifice 94. Side wall 91 also defines annular indentation 95 along its midsection, around which is received annular, rubber gasket 96.

Control valve stem 90 can be freely rotated or turned either in a clockwise or in a counterclockwise direction within passageway 67. As valve stem 90 is rotated in a clockwise direction, the action of threads 72 and 9 cause valve stem to be actuated downwardly. In this case, continued downward movement of valve stem 90 causes the abutment of bottom wall 93 with flange 86, which forces plunger 85 downwardly.

Frictionally engaging the upper portion of side wall 91 is annular control knob 97, having axial passageway 98 defined therethrough. Control knob 97 is press-fit onto control valve stem 90 as shown in FIG. 1, so that the frictional engagement of knob 97 with side wall 91 causes control knob 97 to be immovably attached to valve stem 90. Therefore, the rotation of control knob 97 will also rotate or turn in like direction, valve stem 90. In this manner, control knob 97 is considered integrally connected to valve stem 90.

Control knob 97 is received over the upper flange 73 of control valve assembly 42. Spring-tensioned, wire locking ring 100 is placed between control knob 97 and flange 73 of valve assembly 42, so that control knob 97 cannot be readily removed from control valve assembly 42. Various sizes of locking rings 42 can be used to selectively limit the upward movement by rotation of control knob 97 with respect to upper flange 73 and valve assembly 42. This, of course, will selectively limit the upward or outward movement of valve stem 90, thereby controlling the outflow or emission of fuel, as is hereinafter discussed. Control valve stem 90 also includes upper portion 101 terminating in flange 102. When control knob 97 is properly positioned on valve stem 90, upper portion 101 projects beyond or out of knob 97. Received around upper portion 101 of valve stem 90 between flange 102 and control knob 97, is cylindrical insulating spacer 103. Spacer 103 is made of a rigid synthetic material such as Teflon®, or similar P.T.F.E compound capable of providing the necessary thermal insulation and structural rigidity.

Finned radiator 104 having spaced, annular outer fins 105 is received around Teflon® spacer 103. Radiator 104 defines passageway 106 therethrough and terminates in upper, conical nozzle 107 defining orifice 108. Received within orifice 108 of nozzle 107 is tubular brass tip 109 defining therethrough passageway 110 and including top wall 111 which, in turn, defines centrally disposed orifice 112. Orifice 112 is preferably approximately .09 millimeters in diameter. Cylindrical, elongate filter 8 having a diameter slightly less than the diameter of passageways 92 and 110, is received both within passageway 92 of control valve stem 98 and within passageway 110 of brass tip 109. Filter 8 is frictionally retained within passageways 92 and 108, and is comprised of rigid nylon, or similar material capable of permitting the passage of butane gas therethrough, while preventing the passage of impurities in the fuel.

A portion of brass tip 109 extends outwardly from nozzle 107. Received around brass tip 109 is a second or upper, finned radiator 115. Radiator 115 includes a lower, cylindrical portion 116, and an upper portion 117 having annular, spaced fins 118. Lower portion 116 and upper portion 117 of radiator 115, define therethrough, passageway 119. Defined by lower portion 116 of upper, finned radiator 115 are two, transverse, opposed orifices 120. Preferably, when upper radiator 115 is received around brass tip 109, the lower portion 116 of upper radiator 115 abuts nozzle 107, and orifices 120 are positioned so that the lower circumferences of orifices 120 are transversely aligned with upper wall 111 of brass tip 109. The area of passageway 119 between orifices 120, as well as the area of passageway 119 defined by upper portion 117, is where mixing of air and fuel occurs.

Tubular nozzle 125 frictionally engages around upper finned radiator 115. Brass diffuser cap 126 defining axial passageway 127 therethrough is fixedly attached to spline 140, which is also received within nozzle 125 and frictionally engages finned radiator 115. The combustion zone of apparatus 10 is within tubular nozzle 125.

In explaining the operation of the present invention, it is first assumed that after its assembling in accordance with the above description, the fuel combustion apparatus 10 is in an opened position. In this position, the control knob 97 would be turned or rotated in a counterclockwise direction to its maximum extent, at which time locking ring 100 prevents any further rotation of control knob and thereby also prevents any further counterclockwise rotation of valve stem 90. Before apparatus 10 is filled with pressurized fuel, the valve stem 90 should be biased from an opened position to a closed position. To close control valve assembly 42, control knob 97 is rotated in a clockwise direction, thus also simultaneously rotating valve stem 90. As valve stem 90 is rotated in a counterclockwise direction, the interaction of threads 72 and 9 causes valve stem 90 to move into control valve assembly 42, or downwardly as shown in FIG. 1. As valve stem 90 moves downwardly, plunger 85 is also pushed downwardly or against the tension of spring 89. This causes spring 89 to push against flange 82 of plunger 81, forcing plunger 81 to ultimately seat against shoulder 71 of valve seat 77. Prior to this seating of plunger 81, however, the downward movement of plunger 81 pushes brass disk 76 against microporous sponge 75, compressing sponge 75 against the portion of flange 68 defining orifice 70, thus incrementally closing off all pores in sponge 75 and creating a seal over fuel orifice 70, thereby preventing any fuel from passing through control valve assembly 42. Fuel combustion apparatus 10 is thereby maintained in a closed position.

The longitudinal dimension of side wall 78 of valve seat 77, and the longitudinal dimensions of lower plunger 81 and of upper plunger 85, are such that when flange 86 of upper Plunger 85 abuts the upper circumferential edge of valve seat 77, and when flange 82 of plunger 81 abuts bottom wall 79 of valve seat 77, boss 83 of lower plunger 81 does not contact boss 87 of upper plunger 85. Instead, spring 89 urges lower plunger 81 to seat against the bottom wall 79 of valve seat 77. This prevents sponge or plug 75 from being inadvertently compressed to a point at which it loses its resiliency, which would be detrimental to the operation of fuel combustion assembly 10. As plunger 85 is forced downwardly, compressing spring 89 between flanges 82 and 86, plungers 81 and 85 turn with valve stem 90. Therefore, brass disk 76 is included between boss 84 and sponge 75 to prevent accelerated wear of sponge 75. The closure arrangement described also provides for two, separate positive closures, in series. As sponge 75 is compressed, the passage of fuel will be incrementally reduced, until the porous sponge 75 is compressed to a degree where fuel flow through orifice 70 is stopped, providing the first closure. The fuel downstream of sponge 75 will flow out of valve stem 90. Thereafter, flange 86 seats on the upper circumferential edge of valve seat 77, providing a second, separate closure.

When orifice 70 is closed off by sponge 75, the portion of chamber 12 occupied by porous sponge 35 then can be filled with pressurized fuel, such as butane gas. Fuel combustion assembly 10 is filled with the pressurized butane through valve assembly 13, as is well known in the art. The butane permeates through the pores of sponge 35, which serves to assist in absorbing liquid butane which would normally be present in chamber 12. Counterclockwise rotation of control knob 97 causes valve stem 90 to simultaneously rotate in a counterclockwise direction, which allows spring 89 to relax, thus relieving its closure force from flange 82 of plunger 81. The pressurized gas moves upwardly, or outwardly, through orifice 46 and passes through porous sponge or cork 55. Microporous sponge or cork 55 also assists in absorbing liquid butane, and simultaneously serves to slow the outward flow of fuel. After passing through cork 55, the butane then passes through the first microporous disk 56. This microporous disk 56 allows gas to pass through its pores while substantially restricting the passage of liquid butane. After the gas passes through disk 56, it is forced laterally by solid, brass disk 57. Since the clearance between the circumferential edge 58 of brass disk 57 and side wall 44 is approximately one thousand of an inch or less, the volume of the gas passing around disk 57 is reduced, however, the gas pressure remains substantially the same. The gas passing around brass disk 57 then passes through second microporous disk 60, where any remaining liquid butane is trapped. Thus, the anti-sputter valve assembly 41 ensures that substantially no liquid butane will pass into, and hence out of, control valve assembly 42, which could allow a "flame up" at the point of combustion. The butane gas then passes upwardly through orifice 70 of control valve assembly 42. The gas then passes through porous sponge 75 and around brass disk 76 through orifice 80 of valve seat 77. The gas then passes around flange 82, out of valve seat 77 and around flange 86. At this point, the gas travels through the diametric channel (not shown) in the bottom wall 93 of valve stem 90 and upwardly through passageway 92. The gas finally passes through porous, nylon filter 8 and out of orifice 112 of brass tip 109.

The pressurized gas continues to flow upwardly through passageway 119 of upper finned radiator 117. As the gas passes orifices 120, air is entrained with the gas through orifices 112 and mixed with the butane gas as it moves upwardly through passageway 119. The air-fuel mixture then exits through passageway 127 of diffuser 126. This air-fuel mixture is ignited by an external ignition source.

The flame length extending outwardly from nozzle 125, and/or the temperature of combustion, is selectively controlled by turning or rotating control valve 97, which accurately, incrementally adjusts the flow of fuel through control valve assembly 42 and thereby controls the air-fuel mixture emitting from diffuser cap 126. Unlike the devices of the prior art, the fuel combustion apparatus 10 can be inverted and even shaken without substantially affecting the flame at nozzle 126. This is because of the anti-sputter valve assembly 41 which assists in regulating the flow of fuel and prevents liquid butane from passing through control valve assembly 42.

The flame at diffuser 126, of course, causes the area of nozzle 125 and diffuser 126 to become extremely hot. This heat will be transferred to other elements by metal-to-metal contact. Upper finned radiator 117 dissipates much of this heat to the atmosphere. The remaining heat is transferred to lower finned radiator 104 where another portion of the remaining heat is then dissipated to the atmosphere. Finned radiator 104 is insulated from any contact with control knob 97 by Teflon® insulating spacer 103. Therefore, no heat is transferred past lower finned radiator 104 to control knob 97.

Figure 2:
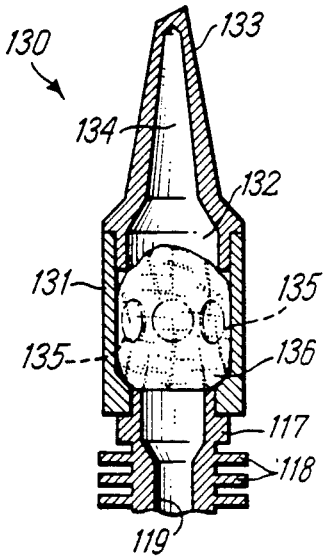
FIG. 2 is a cross-sectional view of a soldering tip assembly, showing the mounting of the soldering tip assembly onto the upper finned radiator of FIG. 1.

FIG. 2 shows soldering tip assembly 130, which can alternatively be engaged with upper, finned radiator 117, rather than nozzle 125 and diffuser 126. Soldering tip assembly 130 includes cylindrical body portion 131 defining chamber 132 therein. Cylindrical body portion 131 then tapers to form a hollow soldering tip 133 which defines therein a tapering chamber 134, as shown in FIG. 2. The body portion 131 of soldering tip assembly 130 includes spaced apertures 135 therethrough. Preferably six equally, circumferentially spaced apertures are included around the body portion 131 of assembly 130. A catalyst 136 is placed within chamber 132, in order to increase the temperature of soldering tip assembly 130. Catalyst 136 is preferably a platinum plated quartz wool catalyst of approximately 0.5% to 1% weight platinum, which catalyst is well known in the art, or palladium plated quartz wool, or similar catalytic compound.

In operation utilizing the soldering tip assembly, control valve 97 is turned in a counterclockwise direction to allow fuel to pass through upper fin radiator 117 and into chamber 132 of assembly 130. The air-gas mixture is ignited by an external ignition source by passing a flame through orifices 135. The products of combustion circulate in chambers 132 and 134 and exit through orifices 135. As the catalyst becomes heated, the soldering tip assembly 130 becomes extremely hot, allowing for efficient soldering.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. A fuel combustion apparatus comprising:

(a) a housing defining an interior chamber for containing a fuel under pressure, said housing defining a fluid passageway in fluid communication with said interior chamber and extending out of said housing;

(b) a nozzle mounted to said housing in fluid communication with said fluid passageway;

(c) a flow control valve mounted in fluid communication with said passageway intermediate said nozzle and said interior chamber for regulating the flow of fuel from said interior chamber to said nozzle wherein said flow control valve comprises a first closure means intermediate said nozzle and said interior chamber for closing off said interior chamber from said nozzle, a second closure means intermediate said first closure means and said nozzle for closing off said nozzle from said first closure means and control means for opening and closing said first and second closure means, said control means being adapted for closing, in sequence, said first closure means and then said second closure means, and for opening, in sequence, said second closure means and then said first closure means; and (d) anti-sputter valve means mounted in fluid communication with said passageway intermediate said nozzle and said chamber for substantially preventing the flow of liquid fuel therethrough while allowing the flow of gaseous fuel therethrough, said anti-sputter valve means comprising a first microporous member.

2. The fuel combustion apparatus defined in claim 1 wherein said anti-sputter valve means is positioned intermediate said flow control valve and said chamber.

3. The fuel combustion apparatus defined in claim 1 wherein said anti-sputter valve means comprises a second microporous member positioned within said passageway and an impermeable member intermediate said first and second microporous members.

4. The fuel combustion apparatus defined in claim 1, wherein said anti-sputter valve means comprises a body defining an open interior, said anti-sputter valve means also defining an orifice along one portion of said body for allowing fuel to enter said open interior, and a fuel permeable member disposed within said open interior.

5. The fuel combustion apparatus defined in claim 4, and a non-permeable disk disposed within said open interior adjacent to said fuel permeable member.

6. The fuel combustion apparatus defined in claim 1, and a heat exchanger disposed between said valve stem and said nozzle.

7. The fuel combustion apparatus defined in claim 6, wherein said heat exchanger includes heat dissipating fins mounted thereto.

8. The fuel combustion apparatus as claimed in claim 1 further comprising a non-metallic member disposed between said housing and said nozzle, said non-metallic member being mounted to said nozzle and to said housing for insulating said housing from heat generated adjacent said nozzle by combustion of the fuel.

9. A fuel combustion apparatus comprising:

(a) a housing defining an interior chamber for containing a fuel under pressure, said housing defining a fluid passageway in fluid communication with said interior chamber and extending out of said housing;

(b) a nozzle mounted to said housing in fluid communication with said fluid passageway;

(c) a flow control valve mounted in fluid communication with said passageway intermediate said nozzle and said interior chamber for regulating the flow of fuel from said interior chamber to said nozzle wherein said flow control valve includes a body defining therethrough a first passageway, a valve stem defining a second passageway, said valve stem received in said first passageway, and a valve closure assembly disposed into said first passageway adjacent to said valve stem, for closing said first passageway, and wherein said valve closure assembly includes a valve seat, a first plunger received in said valve seat, a second plunger disposed adjacent to said first plunger, and a spring disposed between said first plunger and said second plunger; and (d) anti-sputter valve means mounted in fluid communication with said passageway intermediate said nozzle and said chamber for substantially preventing the flow of liquid fuel therethrough while allowing the flow of gaseous fuel therethrough, said anti-sputter valve means comprising a first microporous member.

10. The fuel combustion apparatus as claimed in claim 9 wherein said flow control valve comprises a first closure means intermediate said nozzle and said interior chamber for closing off said interior chamber from said nozzle, a second closure means intermediate said first closure means and said nozzle for closing off said nozzle from said first closure means and control means for opening and closing said first and second closure means, said control means being adapted for closing, in sequence, said first closure means and then said second closure means, and for opening, in sequence, said second closure means and then said first closure means.

* * * * *